US010197074B2

(12) United States Patent
Matsui et al.

(10) Patent No.: US 10,197,074 B2
(45) Date of Patent: Feb. 5, 2019

(54) ACTUATOR

(71) Applicants: TAIHO KOGYO CO., LTD., Toyota-shi, Aichi (JP); TOYOTA JIDOSHA KABUSHIKI KAISHA, Toyota-shi, Aichi (JP)

(72) Inventors: Kuninori Matsui, Toyota (JP); Akitoshi Iwata, Seto (JP); Koichi Yonezawa, Toyota (JP)

(73) Assignees: Taiho Kogyo Co., Ltd., Toyota-shi, Aichi (JP); Toyota Jidosha Kabushiki Kaisha, Toyota-shi, Aichi (JP)

( * ) Notice: Subject to any disclaimer, the term of this patent is extended or adjusted under 35 U.S.C. 154(b) by 163 days.

(21) Appl. No.: 15/322,620

(22) PCT Filed: Jul. 10, 2015

(86) PCT No.: PCT/JP2015/069898
§ 371 (c)(1),
(2) Date: Dec. 28, 2016

(87) PCT Pub. No.: WO2016/006684
PCT Pub. Date: Jan. 14, 2016

(65) Prior Publication Data

US 2017/0152871 A1 Jun. 1, 2017

(30) Foreign Application Priority Data

Jul. 10, 2014 (JP) ..... 2014-142743

(51) Int. Cl.
*F15B 15/10* (2006.01)

(52) U.S. Cl.
CPC ..... *F15B 15/10* (2013.01)

(58) Field of Classification Search
CPC ..... F15B 15/10
See application file for complete search history.

(56) References Cited

U.S. PATENT DOCUMENTS 8,395,374 B2 * 3/2013 Newman ..... G01D 5/145 324/207.24
8,664,947 B2 * 3/2014 Storrie ..... G01B 7/14 324/207.24
9,435,630 B2 * 9/2016 Storrie ..... G01D 5/145

FOREIGN PATENT DOCUMENTS

JP 59-150006 10/1984
JP 61-103607 7/1986
JP 2013-167274 A 8/2013

OTHER PUBLICATIONS

International Search Report (PCT/ISA/210) dated Oct. 6, 2015, by the Japanese Patent Office as the International Searching Authority for International Application No. PCT/JP2015/069898.

(Continued)

*Primary Examiner* — Thomas E Lazo
(74) *Attorney, Agent, or Firm* — Buchanan Ingersoll & Rooney PC

(57) ABSTRACT

There is provided an actuator that can prevent a decrease in strength of a plate due to hydrolysis. The actuator is provided with a diaphragm which divides an inside of a casing into a negative pressure chamber and an atmospheric pressure chamber, a resin plate which is provided inside the negative pressure chamber to contact with the diaphragm, and an operating shaft having one side connected to the plate and the diaphragm and the other side extended outside the casing through the atmospheric pressure chamber, the operating shaft capable of being displaced in the axial direction according to the deformation of the diaphragm. The operating shaft penetrates through the diaphragm to connect to the plate inside the negative pressure chamber so that the plate is blocked from the atmospheric pressure chamber.

2 Claims, 4 Drawing Sheets

(56) References Cited

OTHER PUBLICATIONS

Written Opinion (PCT/ISA/237) dated Oct. 6, 2015, by the Japanese Patent Office as the International Searching Authority for International Application No. PCT/JP2015/069898.

* cited by examiner

ACTUATOR

TECHNICAL FIELD

The present invention relates to techniques of an actuator having an operating shaft which is capable of being displaced in the axial direction according to the deformation of a diaphragm.

BACKGROUND ART

Conventionally, there have been well known techniques of an actuator having a diaphragm dividing an inside of a casing into a negative pressure chamber and an atmospheric pressure chamber, a plate provided inside the negative pressure chamber to contact with the diaphragm, and an operating shaft which is capable of being displaced in the axial direction according to the deformation of the diaphragm, for example, as disclosed in Patent Literature 1.

An actuator disclosed in Patent Literature 1 includes a diaphragm dividing an inside of casings (a first case and a second case) into a negative pressure chamber and an atmospheric pressure chamber, a plate (a diaphragm receiving plate) provided inside the negative pressure chamber to contact with the diaphragm, and an operating shaft (an output member) capable of being displaced in the axial direction according to the deformation of the diaphragm.

With this configuration, the actuator disclosed in Patent Literature 1 causes deformation (movement) of the diaphragm by changing pressure inside the negative pressure chamber, and thereby the operating shaft is displaced in the axial direction. Further, the actuator disclosed in Patent Literature 1 is capable of causing deformation of the diaphragm while maintaining a predetermined shape (specifically, a planar shape at the center) by the plate.

However, the actuator disclosed in Patent Literature 1 is formed such that the plate partially projects from the negative pressure chamber to an inside of the atmospheric pressure chamber through a through hole provided in the diaphragm. Thus, in the actuator disclosed in Patent Literature 1, the plate contacts with the atmosphere, and thereby strength of the plate may be decreased due to hydrolysis.

CITATION LIST

Patent Literature

Patent Literature 1: JP 2013-167274 A

SUMMARY OF THE INVENTION

Problems to be Solved by the Invention

The present invention has been made in view of the above circumstances, and an object thereof is to provide an actuator that can prevent a decrease in strength of a plate due to hydrolysis.

Solutions to the Problems

The problem to be solved by the present invention is as described above and means for solving the problems will be described.

An actuator according to the present invention includes a diaphragm dividing an inside of a casing into a negative pressure chamber and an atmospheric pressure chamber, a resin plate provided inside the negative pressure chamber to contact with the diaphragm, and an operating shaft having one side connected to the plate and the diaphragm and the other side extended outside the casing through the atmospheric pressure chamber, the operating shaft capable of being displaced in the axial direction according to the deformation of the diaphragm. The operating shaft penetrates through the diaphragm to connect to the plate inside the negative pressure chamber so that the plate is blocked from the atmospheric pressure chamber.

In the actuator according to the present invention, the diaphragm includes a through hole through which the operating shaft penetrates, and the operating shaft includes, at the one side thereof, a reduced diameter portion whose diameter is smaller than a diameter of surrounding members. The diaphragm and the operating shaft are connected by fitting the reduced diameter portion to the through hole.

In the actuator according to the present invention, the plate and the operating shaft are connected by insert molding that does not leave a parting line on the surface of the plate contacting with the diaphragm.

Effects of the Invention

The present invention achieves the following effects.

In the actuator according to the present invention, since the plate is blocked from the atmospheric pressure chamber, it is possible to prevent a decrease in strength of the plate due to hydrolysis.

In the actuator according to the present invention, it is possible to connect the diaphragm with the operating shaft directly and to prevent the negative pressure chamber from communicating with the atmospheric pressure chamber.

In the actuator according to the present invention, it is possible to prevent the breakage of the diaphragm due to a parting line of the plate.

EMBODIMENTS OF THE INVENTION

Figure 1:
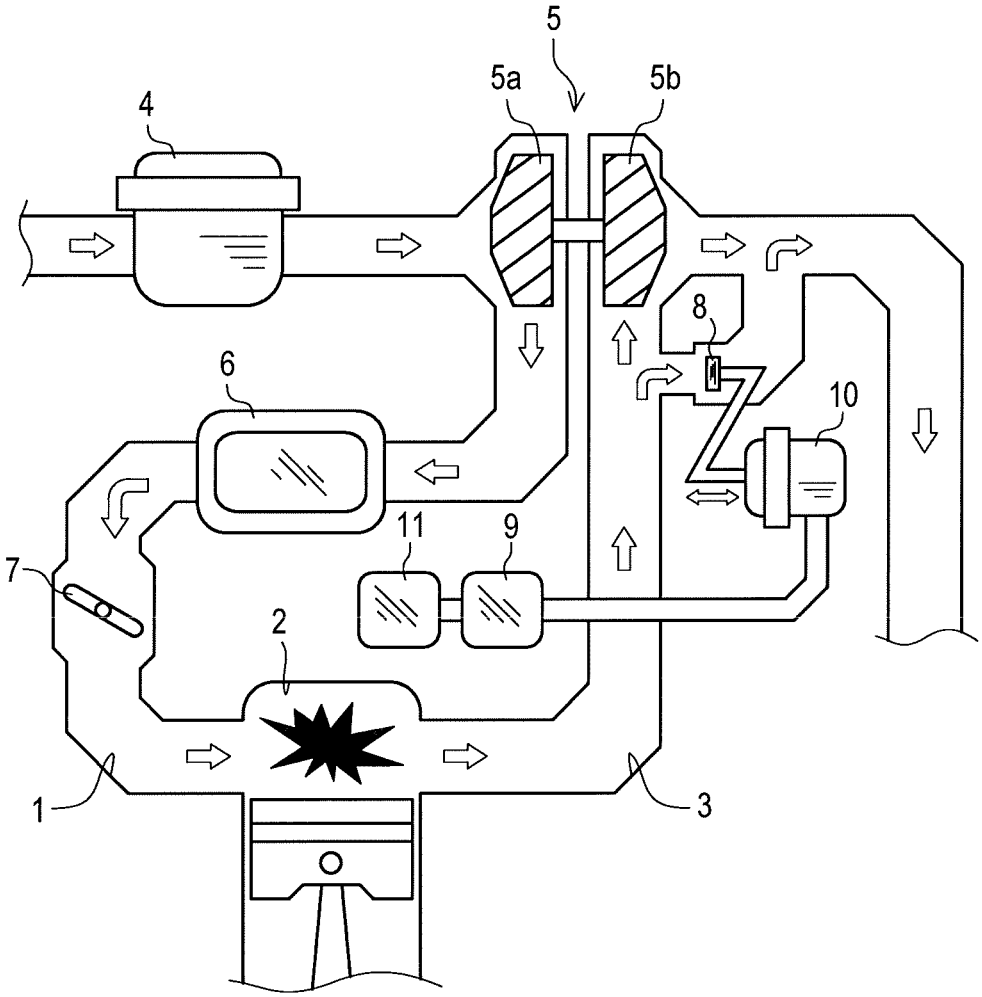
FIG. 1 is a schematic view showing an overview of operation for a turbocharger having an actuator according to an embodiment of the present invention.

In the following FIG. 2 to FIG. 4, the up-down direction, and the right-left direction are defined by arrows illustrated in the drawings.

First, with reference to FIG. 1, the outline of operation of a turbocharger 5 using an actuator 10 according to an embodiment of the present invention will be described.

The turbocharger 5 feeds compressed air into a cylinder 2 of an engine. Air is supplied to the cylinder 2 through an intake passage 1. The air is supplied to the cylinder 2 sequentially through an air cleaner 4, the turbocharger 5, an intercooler 6, and a throttle valve 7 all arranged on the way of the intake passage 1. Since the air is compressed by a compressor 5*a* of the turbocharger 5 at this time, a larger amount of air can be fed into the cylinder 2.

High-temperature air (exhaust air) combusted inside the cylinder 2 is discharged through an exhaust passage 3. At this time, the exhaust air causes a turbine 5*b* of the turbocharger 5 to rotate, and the rotation of the turbine 5*b* is transmitted to the compressor 5*a*. This transmission of the rotation enables compression of air inside the intake passage 1.

On the upstream side of the turbine 5*b*, the exhaust passage 3 is split to separately form a passage which does not pass through the turbine 5*b*. The formed passage can be opened or closed by a waste gate valve 8. The waste gate valve 8 is driven to open or close by the actuator 10. The operation of the actuator 10 is controlled by adjusting a negative pressure, which is generated from a negative pressure generating device 11 such as a vacuum pump, by a negative pressure adjustment mechanism 9 which includes, for example, a solenoid valve. Opening or closing the waste gate valve 8 by the actuator 10 enables adjustment of the flow rate of exhaust air fed to the turbine 5*b*.

Next, the configuration of the actuator 10 will be described with reference to FIG. 2.

The actuator 10 is configured to displace an operating shaft 60 in the axial direction according to the deformation of a diaphragm 30 and to drive to open or close the waste gate valve 8 according to the displacement of the operating shaft 60. The actuator 10 is fixed on an attachment base 100 which is provided in the engine appropriately. The actuator 10 mainly includes a casing 20, the diaphragm 30, a plate 40, a spring 50, the operating shaft 60, a shaft guide 70, and a housing portion 80.

The casing 20 is a main structure of the actuator 10. The casing 20 is mainly provided with an upper casing 21 and a lower casing 22.

The upper casing 21 is a member which configures an upper portion of the casing 20. The upper casing 21 is formed in a substantially bowl shape with the lower side open. The upper casing 21 has an upper plate whose central portion has a recessed shape to which one end of a negative pressure passage 23 is communicatively connected. The other end of the negative pressure passage 23 is connected to the negative pressure adjustment mechanism 9 described above.

The lower casing 22 is a member which configures a lower portion of the casing 20. The lower casing 22 is formed in a substantially bowl shape with the upper side open. The lower casing 22 is fixed on the attachment base 100, and thus the casing 20 is fixed on the attachment base 100. The casing 20 is formed by connecting an upper edge of the lower casing 22 to a lower edge of the upper casing 21.

The diaphragm 30 is configured to divide the inside of the casing 20 into a negative pressure chamber 21*a* and an atmospheric pressure chamber 22*a*. More specifically, the negative pressure chamber 21*a* is formed between the diaphragm 30 and the upper casing 21, and the atmospheric pressure chamber 22*a* is formed between the diaphragm 30 and the lower casing 22. The diaphragm 30 is formed of a flexible material such as a rubber and is configured so as to be deformable (movable). The diaphragm 30 is formed in a substantially bowl shape with the upper side open (in an initial state to be described below). A center of the diaphragm 30 has a through hole 31 which penetrates through the diaphragm 30 in the up-down direction. An outer peripheral edge of the diaphragm 30 is clamped between a lower edge of the upper casing 21 and an upper edge of the lower casing 22.

With this configuration, an upper air chamber (the negative pressure chamber 21*a*) is formed between the diaphragm 30 and the upper casing 21, and a lower air chamber (the atmospheric pressure chamber 22*a*) is formed between the diaphragm 30 and the lower casing 22. The negative pressure chamber 21*a* is configured so as to be supplied with a negative pressure (air pressure lower than atmospheric pressure) generated by the negative pressure generating device 11 through the negative pressure passage 23. Further, the atmospheric pressure chamber 22*a* is kept at atmospheric pressure by communicating with the outside of the casing 20 through a communicating hole (not shown) formed in the lower casing 22. The negative pressure chamber 21*a* and the atmospheric pressure chamber 22*a* are configured not to communicate each other.

The plate 40 is provided inside the negative pressure chamber 21*a* to contact with the diaphragm 30. The plate 40 is formed of resin material. The plate 40 is formed in a substantially bowl shape along an inner surface (upper surface) of the diaphragm 30. A lower surface of a center of the plate 40 is formed in a planar shape and is configured to contact with an upper surface of a center of the diaphragm 30 constantly. Thereby, when the diaphragm 30 is deformed, the plate 40 enables the diaphragm 30 to deform a shape of a peripheral wall with keeping a central shape in a planar shape. An upper surface of a center of the plate 40 is provided with a spring receiver 41 having a substantially annular shape in plan view.

The spring 50 is configured to bias the plate 40 downward. The spring 50 is provided inside the negative pressure chamber 21*a*. An upper end of the spring 50 is abutted to the lower surface of the upper plate of the upper casing 21. A lower end of the spring 50 is fitted to the spring receiver 41 of the plate 40. In this way, the plate 40 constantly presses the diaphragm 30 to the lower side (the atmospheric pressure chamber 22*a* side) by biasing force of the spring 50.

The operating shaft 60 is configured to be displaced in the axial direction according to the deformation of the diaphragm 30. The operating shaft 60 is formed of a metal material having a high heat resistance. The operating shaft 60 is positioned with the longitudinal direction thereof directed in the up-down direction. The operating shaft 60 is guided in the displacing direction (the axial direction) by the shaft guide 70. The operating shaft 60 has one side (upper side) connected to the plate 40 and the diaphragm 30 and the other side (lower side) extended through the atmospheric pressure chamber 22*a* to the outside of the casing 20 (further, to the lower side of the attachment base 100 through an attachment base through hole 101 provided in the attachment base 100). The other side (lower side) of the operating shaft 60 is connected to the waste gate valve 8 through a link mechanism and so on (not shown). The operating shaft 60 is provided with, at the one side (upper side) thereof, a connecting portion 61 for connecting with the plate 40 and the diaphragm 30.

The shaft guide 70 is configured to guide the operating shaft 60 slidably. The shaft guide 70 is formed of resin material. The shaft guide 70 is housed in the housing portion 80 to be described below. The shaft guide 70 is positioned at the lower side of a lower plate of the atmospheric pressure chamber 22*a*. The shaft guide 70 may be positioned above the lower plate of the atmospheric pressure chamber 22*a*.

The housing portion 80 is configured to house the shaft guide 70 inside thereof. The housing portion 80 is positioned at the lower end of the atmospheric pressure chamber 22*a*. In the present embodiment, the housing portion 80 is provided as a part of the lower plate of the lower casing 22 (integrally), it may be provided as a separate body. The housing portion 80 is formed of a metal member. The housing portion 80 is formed in a substantially cylindrical shape with the lower side open.

In the actuator 10 as configured above, description given below is an initial state in which a negative pressure is not supplied to the negative pressure chamber 21*a* and a movable state in which a negative pressure is supplied to the negative pressure chamber 21*a*.

Figure 2:
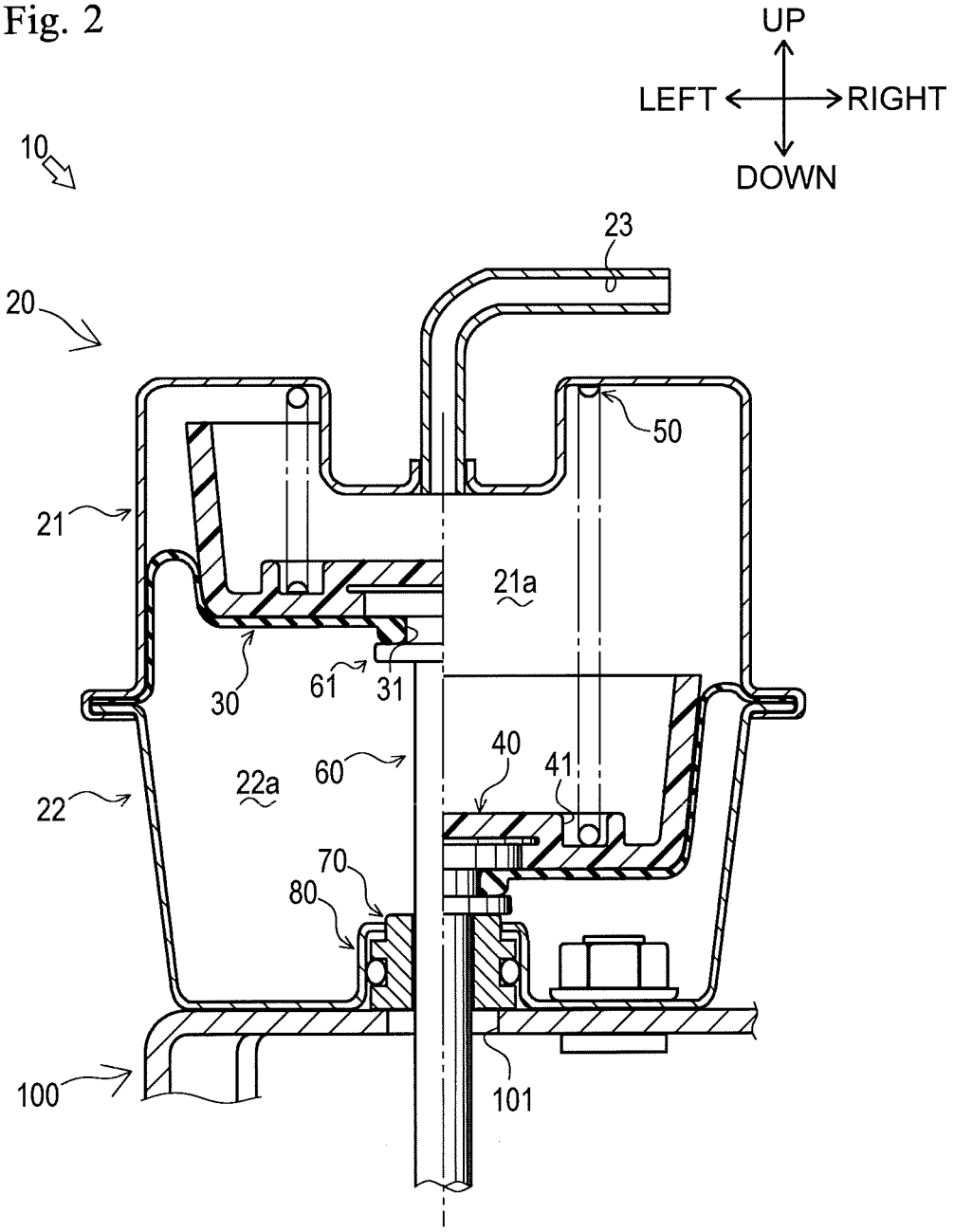
FIG. 2 is a sectional view showing the actuator according to the embodiment in an initial state and in a movable state.

In the initial state, as shown in the right half of FIG. 2, the plate 40 and the diaphragm 30 are pressed to the lower side (to the atmospheric pressure chamber 22*a* side) by biasing force of the spring 50 so that the connecting portion 61 of the operating shaft 60 connected to the diaphragm 30 contacts with the shaft guide 70. In this initial state, the plate 40 and the diaphragm 30 are positioned at the most lower side (at the atmospheric pressure chamber 22*a* side) so that the operating shaft 60 connected to the diaphragm 30 is also displaced closest to the atmospheric pressure chamber 22*a* side.

Further, when the state is changed from the initial state to the movable state, namely when a negative pressure is generated from the negative pressure generating device 11, the negative pressure is supplied to the negative pressure chamber 21*a* through the negative pressure passage 23 after being adjusted by the negative pressure adjustment mechanism 9. This negative pressure causes deformation of the diaphragm 30 so that the central portion of the plate 40 and the diaphragm 30 is displaced to the upper side (to the negative pressure chamber 21*a* side) against the biasing force of the spring 50. The operating shaft 60 connected to the diaphragm 30 is also displaced to the upper side (to the negative pressure chamber 21*a* side). Accordingly, in the movable state, a displacement amount of the operating shaft 60 can be adjusted by controlling a negative pressure which is supplied to the negative pressure chamber 21*a*, and thus the waste gate valve 8 can be driven to open or close (refer to FIG. 1).

Hereinbelow, detailed description for the configuration of the connection of the plate 40 and the diaphragm 30 with the operating shaft 60 will be described with reference to FIGS. 2 to 4.

Figure 3:
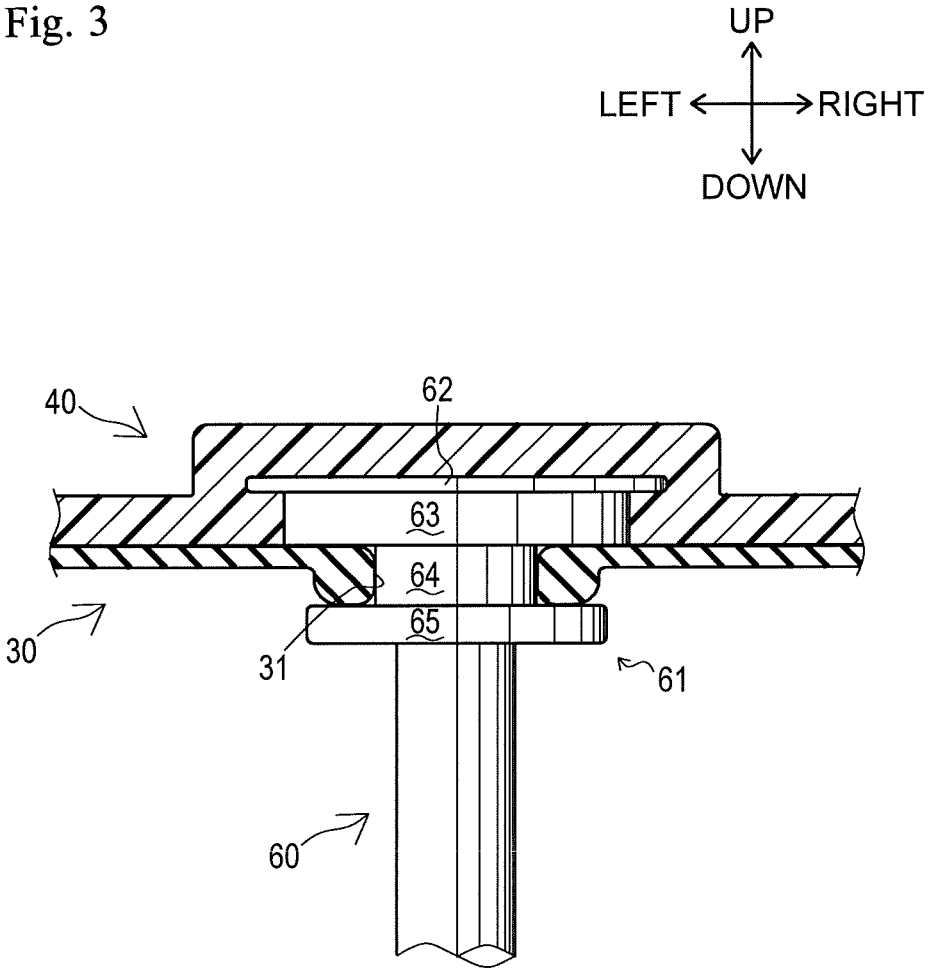
FIG. 3 is a sectional view showing a configuration for connecting a plate and a diaphragm with an operating shaft.

With reference to FIG. 2 and FIG. 3, detailed description for the configuration of the connecting portion 61 of the operating shaft 60 will be described.

The connecting portion 61 is configured to connect the operating shaft 60 with the plate 40 and the diaphragm 30. The connecting portion 61 is positioned at the end of one side (upper side) of the operating shaft 60. The connecting portion 61 is formed in a substantially columnar shape with the axial direction thereof directed in the up-down direction. The connecting portion 61 extends to the outermost diameter of the operating shaft 60.

Middle of the connecting portion 61 in the up-down direction has a reduced diameter portion 64 whose diameter is smaller than that of surrounding members (more specifically, an increased diameter portion 63 and a flange portion 65 to be described below). The diameter of the reduced diameter portion 64 is forming slightly larger than that of the through hole 31 of the diaphragm 30 described above. Hereinbelow, in the connecting portion 61, a member disposed above the reduced diameter portion 64 is referred to as "the increased diameter portion 63", and a member disposed below the reduced diameter portion 64 is referred to as "the flange portion 65".

The diameter of the increased diameter portion 63 is fat lied larger than that of the flange portion 65. A disc portion 62 having a disc shape is provided on the upper surface of the increased diameter portion 63. The diameter of the disc portion 62 is formed larger than that of the increased diameter portion 63.

The connecting portion 61 as configured above is connected with the plate 40 by insert molding. More specifically, the increased diameter portion 63 and the disc portion 62 of the connecting portion 61 are configured with the plate 40 integrally by insert molding. With this configuration, since the operating shaft 60 and the plate 40 do not move relatively, it is possible to prevent wear and breakage in the connecting portion 61 for connecting the operating shaft 60 with the plate 40. Further, since the operating shaft 60 and the plate 40 are configured integrally by insert molding, it is possible to reduce the manufacturing process of connecting the operating shaft 60 with the plate 40.

Further, in insert molding of the connecting portion 61 with the plate 40, since the plate 40 has no undercut, it is possible to split a mold in the up-down direction. More specifically, a parting surface of the connecting portion 61 and the plate 40 in insert molding is set to conform with the surface orthogonal to the axial direction of the operating shaft 60 (for example, the lower surface of the plate 40).

With this configuration, it is possible to prevent a parting line from being formed on the plate 40. Specifically, since a parting line is not formed on the plate 40 that is a member contacting with the diaphragm 30 (further, since the surface of the plate 40 contacting with the diaphragm 30 has no parting line), it is possible to prevent the breakage of the diaphragm 30 due to the parting line.

Further, when the connecting portion 61 and the plate 40 are connected to each other, the reduced diameter portion 64 and the flange portion 65 of the connecting portion 61 project below the plate 40. The reduced diameter portion 64 in a projected state is fitted to the through hole 31 of the diaphragm 30, and thus the diaphragm 30 and the operating shaft 60 are connected to each other.

Figure 4:
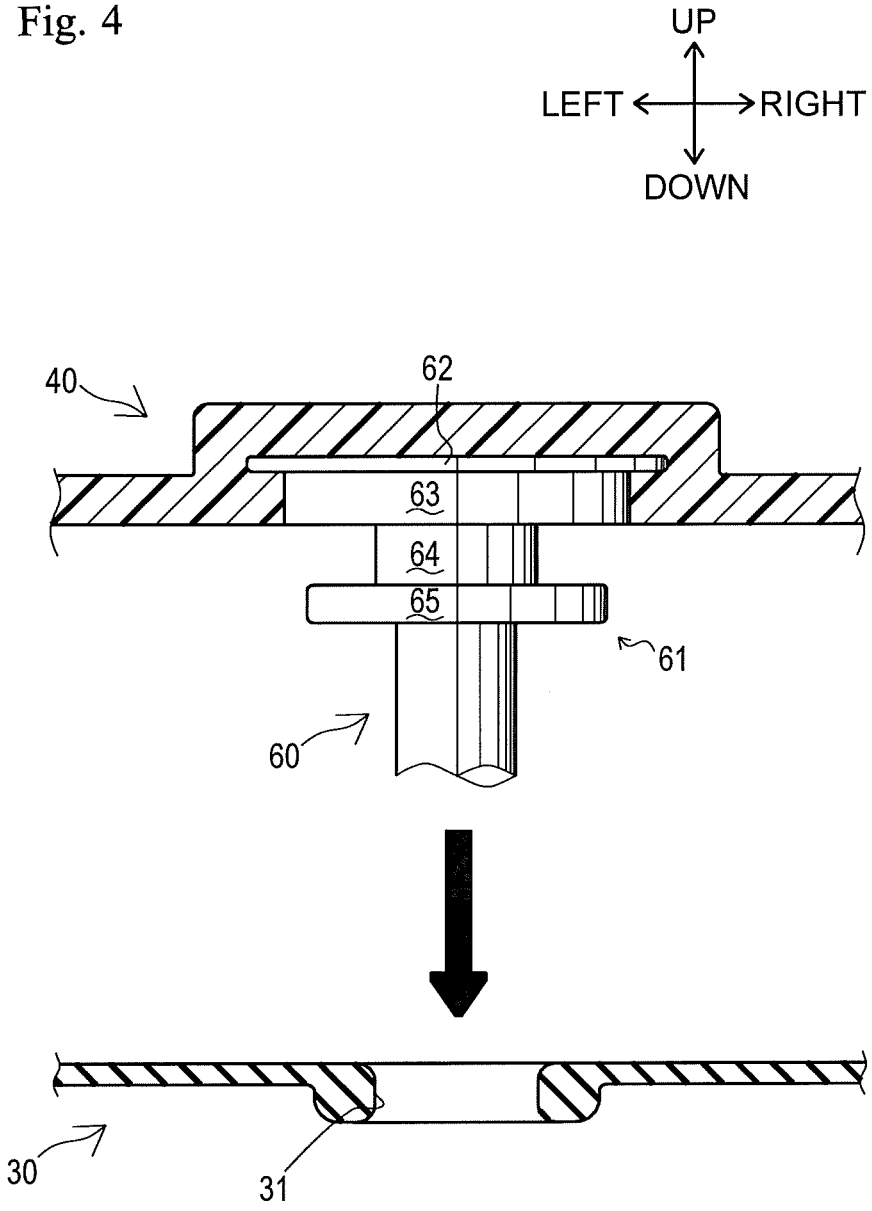
FIG. 4 is a sectional view showing a state in which the plate and the diaphragm are assembled with the operating shaft.

In detail, as shown in FIG. 4, when the diaphragm 30 and the operating shaft 60 are connected (assembled) to each other, the operating shaft 60 is inserted through the through hole 31 of the diaphragm 30. At this time, the through hole 31 of the diaphragm 30 is deformed elastically such that the flange portion 65 of the connecting portion 61 is inserted thereto, and thus the through hole 31 is engaged with the reduced diameter portion 64 of the connecting portion 61 (refer to FIG. 3).

With this configuration, it is possible to connect the diaphragm 30 with the operating shaft 60 easily by fitting the reduced diameter portion 64 of the connecting portion 61 to the through hole 31 of the diaphragm 30. Further, it is possible to prevent the negative pressure chamber 21*a* from communicating with the atmospheric pressure chamber 22*a* through the through hole 31 of the diaphragm 30.

As shown in FIG. 2 and FIG. 3, when the plate 40 and the diaphragm 30 are connected with the operating shaft 60, the increased diameter portion 63 and the disc portion 62 of the connecting portion 61 are disposed above the diaphragm 30. Specifically, the increased diameter portion 63 and the disc portion 62 of the connecting portion 61 penetrate through the diaphragm 30 and are disposed inside the negative pressure chamber 21*a*. The increased diameter portion 63 and the disc portion 62 of the connecting portion 61 are connected to the plate 40 inside the negative pressure chamber 21*a*. Thus, the plate 40 is connected to the operating shaft 60 with the entire plate 40 disposed in the negative pressure chamber 21*a*.

With this configuration, the plate 40 is connected with the operating shaft 60 with the entire plate 40 disposed inside the negative pressure chamber 21*a*, and further the negative pressure chamber 21*a* and the atmospheric pressure chamber 22*a* are configured not to communicate each other. Thereby, the plate 40 is blocked from the atmospheric pressure chamber 22*a*. As a result, it is possible to prevent the plate 40 from contacting with the atmosphere, and thus prevent a decrease in strength of the plate 40 due to hydrolysis.

As described above, the actuator 10 according to the embodiment of the present invention is provided with the diaphragm 30 which divides the inside of the casing 20 into the negative pressure chamber 21*a* and the atmospheric pressure chamber 22*a*, the resin plate 40 which is provided inside the negative pressure chamber 21*a* to contact with the diaphragm 30, and the operating shaft 60 having one side connected to the plate 40 and the diaphragm 30 and the other side extended outside the casing 20 through the atmospheric pressure chamber 22*a*, the operating shaft 60 capable of being displaced in the axial direction according to the deformation of the diaphragm 30. The operating shaft 60 penetrates through the diaphragm 30 to connect to the plate 40 inside the negative pressure chamber 21*a* so that the plate 40 is blocked from the atmospheric pressure chamber 22*a*.

With this configuration, since the plate 40 in the actuator 10 is blocked from the atmospheric pressure chamber 22*a*, it is possible to prevent a decrease in strength of the plate 40 due to hydrolysis.

In the actuator 10, the diaphragm 30 is provided with the through hole 31 through which the operating shaft 60 penetrates, the operating shaft 60 is provided with, at the one side thereof, the reduced diameter portion 64 whose diameter is smaller than a diameter of surrounding members, and the diaphragm 30 and the operating shaft 60 are connected by fitting the reduced diameter portion 64 to the through hole 31.

With this configuration, in the actuator 10, it is possible to connect the diaphragm 30 with the operating shaft 60 directly, and to prevent the negative pressure chamber 21*a* from communicating with the atmospheric pressure chamber 22*a*.

Further, in the actuator 10, the plate 40 and the operating shaft 60 are connected by insert molding that does not leave a parting line on the surface of the plate 40 contacting with the diaphragm 30.

With this configuration, the actuator 10 can prevent the breakage of the diaphragm 30 due to the parting line of the plate 40.

Although the actuator 10 is used in the turbocharger 5 in the present embodiment, the present invention is not limited to this configuration. The actuator 10 may be used in any way.

INDUSTRIAL APPLICABILITY

The present invention is applicable to an actuator having an operating shaft which is capable of being displaced in the axial direction according to the deformation of a diaphragm.

DESCRIPTION OF REFERENCE SIGNS

10: Actuator
20: Casing
21*a*: Negative pressure chamber
22*a*: Atmospheric pressure chamber
30: Diaphragm
40: Plate
60: Operating shaft

The invention claimed is:

1. An actuator comprising:

a diaphragm dividing an inside of a casing into a negative pressure chamber and an atmospheric pressure chamber;

a resin plate provided inside the negative pressure chamber to contact with the diaphragm; and an operating shaft having one side connected to the plate and the diaphragm and the other side extended outside the casing through the atmospheric pressure chamber, the operating shaft capable of being displaced in the axial direction according to the deformation of the diaphragm, wherein the operating shaft penetrates through the diaphragm to connect to the plate inside the negative pressure chamber so that the plate is blocked from the atmospheric pressure chamber, and the plate and the operating shaft are connected by insert molding that does not leave a parting line on the surface of the plate contacting with the diaphragm.

2. The actuator according to claim 1, wherein the diaphragm includes a through hole through which the operating shaft penetrates, the operating shaft includes, at the one side thereof, a reduced diameter portion whose diameter is smaller than a diameter of surrounding members, and the diaphragm and the operating shaft are connected by fitting the reduced diameter portion to the through hole.

* * * * *